United States Patent [19]

Rea

[11] 4,194,741

[45] Mar. 25, 1980

[54] BOARD GAME APPARATUS

[76] Inventor: David M. Rea, 12106 Lerner Pl., Bowie, Md. 20715

[21] Appl. No.: 920,990

[22] Filed: Jun. 30, 1978

[51] Int. Cl.[2] ..... A63F 3/00; A63F 3/02

[52] U.S. Cl. ..... 273/243; 273/260

[58] Field of Search ..... 273/260, 146, 243, 262, 273/253

[56] References Cited

U.S. PATENT DOCUMENTS

| | | | |
|---|---|---|---|
| 519,326 | 5/1894 | Davids | 273/262 |
| 647,887 | 4/1900 | Smith | 273/260 |
| 689,137 | 12/1901 | Snyder | 273/260 |
| 1,405,988 | 2/1922 | Erwin | 273/260 |
| 3,642,286 | 2/1972 | Moore | 273/260 X |
| 3,844,563 | 10/1974 | Isaac | 273/260 |
| 3,973,775 | 8/1976 | Bolan et al. | 273/253 |
| 4,092,029 | 5/1978 | Jones | 273/146 X |
| 4,097,050 | 6/1978 | Miller | 273/243 |
| 4,106,774 | 8/1978 | Sequin | 273/146 X |

*Primary Examiner*—Richard C. Pinkham
*Assistant Examiner*—Scott L. Brown
*Attorney, Agent, or Firm*—Thomas E. Beall, Jr.

[57] ABSTRACT

The square game board has a peripheral pattern of alternating playing squares and non-playing squares in a checker board pattern together with a central four-sided ring of playing squares surrounding a central-most non-playing area. Die is provided to chance control the number of moves and forward or backward direction of moves in the peripheral area and/or the number of moves in and the peripheral direction within the ring, only if an opponent's piece cannot be jumped, which jumping is mandatory. Occupation of the four corners of the ring will permit removal of any pieces from the players back row, with the object being to remove all of your pieces or occupy only the four corners of the ring.

11 Claims, 5 Drawing Figures

BOARD GAME APPARATUS

BACKGROUND OF THE INVENTION

The present invention generally relates to a chance controlled game with movable pieces.

Game boards with movable pieces and chance controlled games are numerous and well known, with their objects to promote various mental skills in addition to providing entertainment. All such games accomplish these purposes to a varying degree.

However, there is always a need for even more skillful and enjoyable games, without being unduly complicated.

SUMMARY OF THE INVENTION

It is an object of the present invention to provide an entertaining, skillful game that may be easily learned and played by a wide variety of people. More specifically, the game employs chance controlled, with choices, movable pieces that are moved on a game board in combat with another player.

The square game board has a peripheral pattern of alternating playing squares and non-playing squares in a checker board pattern together with a central four-sided ring of playing squares surrounding a central-most non-playing area. Die is provided to chance control the number of moves and forward or backward direction of moves in the peripheral area and/or the number of moves in and the peripheral direction within the ring, only if an opponent's piece cannot be jumped, which jumping is mandatory. Occupation of the four corners of the ring will permit removal of any pieces from the players back row, with the object being to remove all of your pieces or occupy only the four corners of the ring.

The ring, or chase area, is unusual in providing additional mobility to the pieces, additional choices for the chance controlled movements, and rewards for occupying specific positions. The central non-playing area increases the complexity and interest of the game.

BRIEF DESCRIPTION OF THE DRAWING

Further objects, features and advantages of the present invention will become more clear from the following detailed description of a preferred embodiment, shown in the accompanying drawing, wherein.

DETAILED DESCRIPTION OF THE DISCLOSURE

The apparatus of the present invention consists of a game board, two sets of game pieces for two players, and a die. The two players face each other with the game board between them, and start from opposite ends of the game board with play being controlled by a combination of chance and choice.

The die is conventional in construction in that it is a six-sided cube. The game can be played with one die, or each player may have their down die. The die is unique with respect to the indicia on the six faces of the die. In FIG. 1*a*, the six faces of the die are layed out, to show that they are respectively provided with indicia f1, f2, f3, b1, b2, b3, or other suitable indicia that will represent and give instructions for piece movement and direction. When the die is thrown, the instruction that is facing upwardly will determine player movement. b1 means backward movement one space, b2 means backward movement two spaces, b3 means backward movement three spaces, f1 means forward movement one space, f2 means forward movement two spaces, and f3 means forward movement three spaces.

Figure 1:
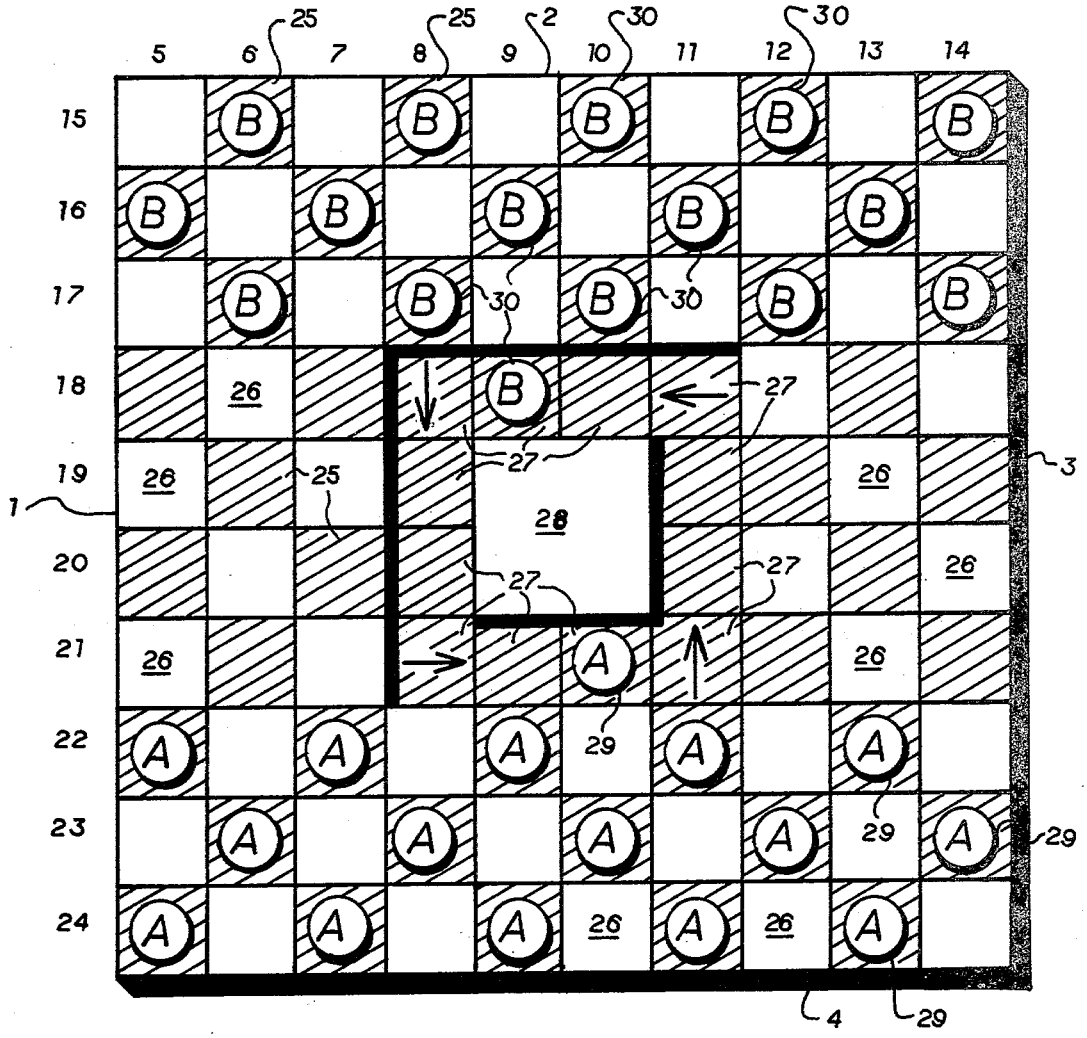
FIG. 1 is a plan view of a game board illustrating the game pieces in their positions to begin the game.
Figure 1A:
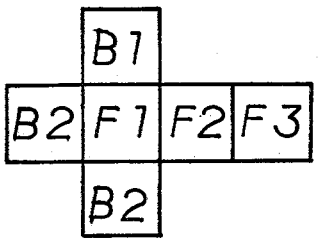
FIG. 1*a* is an exploded view of the six sides of the die.

The game board shown in FIG. 1 is a rectangular board having any desired thickness, and being provided with four sides 1, 2, 3, 4. The game board has an outer periphery defining the main playing area and in turn being defined by columns 5, 6, 7, 12, 13, and 14, together with rows 15, 16, 17, 22, 23, and 24. Within this outer periphery, the squares formed by the intersections of columns and rows are provided with indicia distinguishing alternate squares from adjacent squares. Specifically, alternate squares are shown shaded in the drawing to represent a color different from the adjacent squares. By indicia, applicant means any visual characterization wherein one area, piece, or surface may be distinguished from another, for example by a change in color, a change in texture, a change in lettering, a change in numbering, or a pictorial change. Play is conducted only on the alternate squares 25 that are shown shaded in the drawing, and the pieces never land on or move across the adjacent squares 26 that are shown unshaded in the drawing.

In addition to the outer periphery described above, the game board includes an inner or central ring, which represents the ring area of the gameboard. This ring area defined only by the squares formed by the intersection of column 8 with rows 18, 19, 20, 21; the intersection of column 9 with rows 18 and 21; the intersection of column 10 with rows 18 and 21; and the intersection of column 11 with rows 18, 19, 20 and 21. The game pieces land on and move across all of the squares of the ring and to indicate this, indicia are provided on all such squares, particularly, all such squares have the same color as the alternate squares 25. To further distinguish the ring from the remainder of the playing board, the ring is preferably at a lower level than the remainder of the playing board, that is, formed within a channel consisting of the ring squares 27 that are at a lower level than the alternate squares 25 and adjacent squares 26, with it being understood that the alternate squares 25 and adjacent squares 26 are on a common level with themselves and with the central area 28 within the ring.

The game pieces are thirty-two in number, and are divided into two sets of sixteen each. The game pieces within each set are identical, but the game pieces of one set are distinguishable from the game pieces of the other set by indicia. In FIG. 1, all of the game pieces are of the same size and shape, that is, disc-shaped. One set of game pieces 29 have indicia A, whereas the other set of game pieces 30 have indicia B.

A first player is provided with game pieces 29 arranged in positions shown in FIG. 1 to start the game, and the second player is provided with game pieces 30 arranged in the position shown in FIG. 1 to start the game. The first player preferably is positioned adjacent side 4, whereas the second player is preferably positioned adjacent the side 2. Row 24 is termed the first player's back row, whereas row 15 is termed the second player's back row. A plurality of rows adjacent the player's position, that is, rows 22, 23, 24 for the first player and rows 15, 16, 17 for the second player define the respective beginning squares 25 where pieces are positioned, with it being understood that one piece of each player is positioned within the ring, preferably as indicated.

Within the ring, the ring squares 27 are provided with indicia to distinguish them from the remaining squares, and preferably somewhere in the ring one or more arrows are positioned to indicate a forward direction of movement. As shown in the preferred embodiment, these functions are accomplished by placing an arrow in each of the four corner squares 27. The direction of movement for game pieces in the ring is as indicated as counter-clockwise for forward.

For each player, the term forward is defined as being away from the player, whereas the term backward is defined as toward the player, with respect to game piece movement. With the two players facing each other, a move that would be forward for one player would be backward for the other player for squares 25.

Also for reference, the squares 25 and 27 occupied by game pieces in FIG. 1 may be termed starting positions or starting squares, and all of the squares 25, 27 are playing positions or spaces.

Since the game is played with two players, the two players are opponents and the object is to be the first player to either have all of your game pieces removed, or have only four of your game pieces remain and have such four remaining game pieces respectively on the four corners of the ring, and in either event, the player accomplishing such is the winner.

To start the game, some method is employed to determine the starting player, for example the die may be rolled with the highest roll going first, with forward being considered higher than backward and with respect to forward indicia, the higher numbered forward indicia being considered higher. The playing piece of one player is removed when it is jumped by a playing piece of the other player, with a jump being conducted in any direction in the nature of conventional checkers directly over the piece to be captured so as to land in an open playing space. If a player is able to jump the piece of another player, the first player is required to jump as many pieces as possible when it is the turn for the first player to move. Also, if the playing pieces of one player occupy all four corners of the ring, all of the one player's playing pieces in the one player's back row are removed, and as long as all four corners of the ring are covered, any of the one player's pieces moved into the one player's back row are also immediately removed at any time during the game.

The moves of the individual players are controlled by chance, choice and the rules of the game. If it is the move of one player and the pieces of such one player cannot jump the pieces of the other player, than the die is rolled to give any one of the six possible move instructions to the one player, for example, backward three spaces as determined by the die showing "b3" on its top surface. A legal move would be one in accordance with the instruction of the die and where the last space of the move is open for reception of the playing piece (occupied spaces may be traversed as part of a move). If no move in compliance with the rules and the instructions of the die can be made, then that player is passed and it then becomes the turn for the other player to move. No space may be used or counted twice in a single turn or move. If a player moves over a space occupied by the opponent, passing over the playing piece of the opponent does not constitute a jump, so that the piece is not removed during a move that is conducted in accordance with the instruction of the die.

A move is initiated with rolling the die when no jump can be made. Players begin the game in the starting configuration of FIG. 1. After a die roll is made, the player whose turn it is may choose one of their pieces that can be moved the exact number of spaces shown on the die and in the correct direction of the die instruction so as to land on an unoccupied space, never using the same space twice in a move and not removing any pieces from the board.

Figure 2:
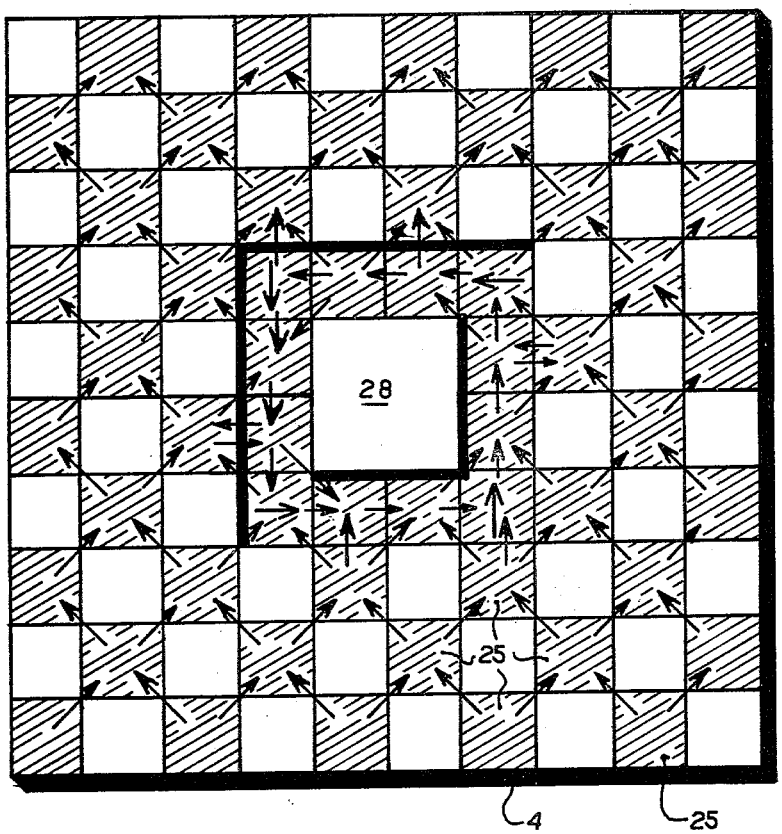
FIG. 2 is a plan view of the game board, with pieces removed, and arrows showing all of the possible "forward" moves for player A.
Figure 3:
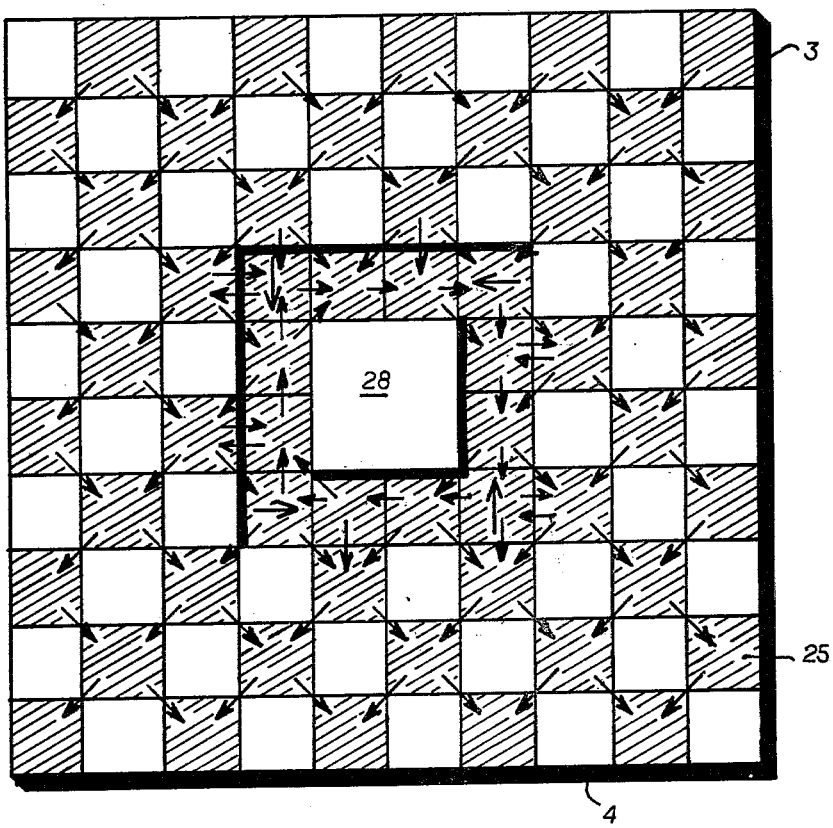
FIG. 3 is a plan view of the game board with all of the pieces removed and showing, by arrows, all of the possible "backward" moves for player A.

With respect to FIG. 2, all possible forward moves between playing spaces are shown for the player located adjacent side 4, whereas in FIG. 3 all possible backward moves between spaces 25 and 27, that is the playing spaces, are represented by arrows for a player at the same location as discussed with respect to FIG. 2. With respect to FIGS. 2 and 3, it is seen that backward movements within the ring are defined as clockwise, whereas forward movements within the ring are defined as counterclockwise. Further, movement from a space 27 to a space 25 within a same row are considered either backward or forward. Thus, pieces within the ring and in spaces 25 adjacent the ring have greater mobility than pieces on the other playing spaces.

Figure 4:
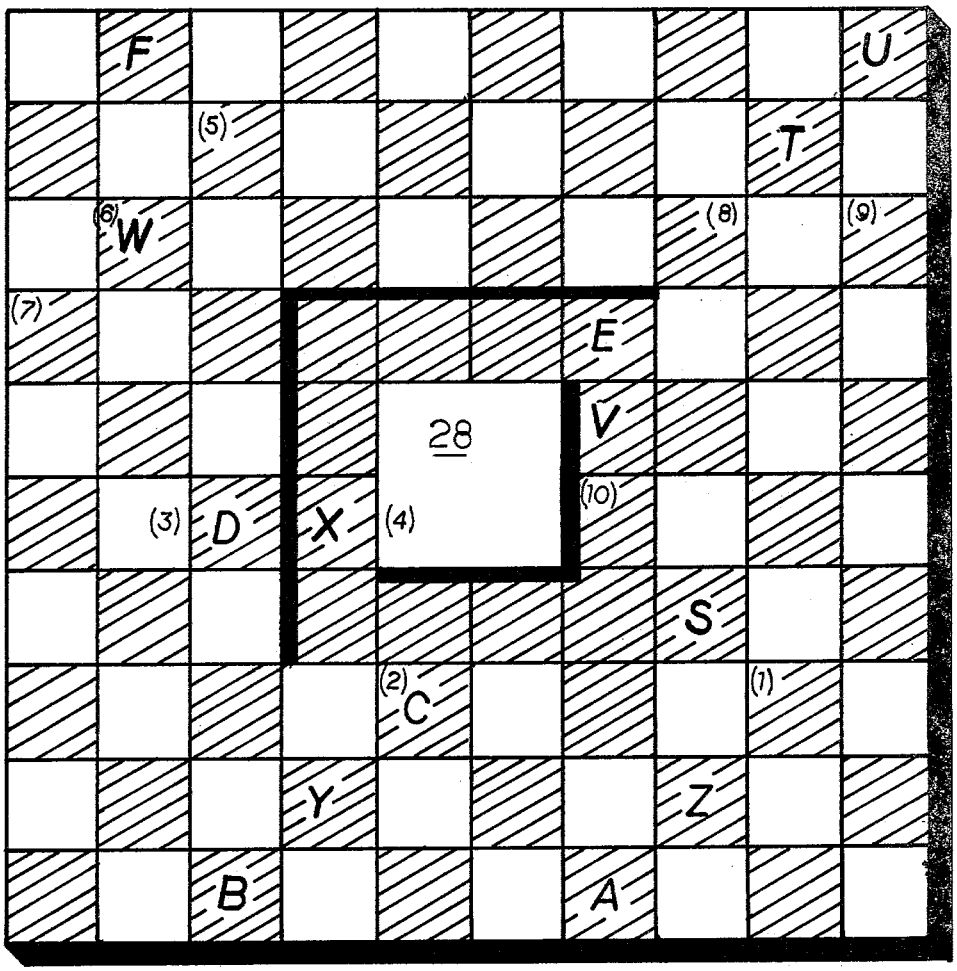
FIG. 4 is a plan view of the game board, with various playing combinations being illustrated schematically.

As specific examples of possible moves, reference is made to the various combinations set up in FIG. 4. FIG. 4 is not intended to represent any specific game, but a plurality of separate and independent combinations are set forth and will be discussed.

(1) In the first situation, a player having a piece at playing space A must jump the opponents piece occupying space Z, if space (1) is unoccupied and it is the first player's turn, and the first player must also in the same move jump an opponent's piece occupying space S if space (10) is unoccupied. However, the move will end with the first player's piece from space A remaining at space 10, because an opponent's piece at space V cannot be jumped because space E is occupied by one of the player's pieces.

(2) A first player's piece at position B cannot jump the opponent's piece at Y, since space C is occupied.

(3) One player's piece D cannot jump the opponent's piece X, since there is no space at 4 that is within the non-playing area 28.

(4) One opponent having a piece at space E must jump the opponent's piece at space V since a jump can be made in any direction and since the space at (10) is unoccupied.

(5) If the player having a piece at F receives a die instruction "backward 3" and chooses to move from F to space 7 by movement through spaces 5 and 6, the opponent's piece at space W is not removed, since such is not a jump but rather a move initiated by a roll of the die.

(6) A first player having a piece at Y can jump its opponent's piece at C, but not its opponent's piece at position B.

(7) A player having a piece at position X cannot jump its opponent's piece at position D, since there is no playing space at (3).

(8) A player having a piece at position V cannot jump its opponent's piece at position E, for the reason mentioned above with respect to example (7).

(9) If a player having a piece at position U obtains an instruction "forward 2" from the die, the piece at position U can be moved to 8 or 9, since they are both open.

The above examples are merely illustrative, and from FIGS. 2 and 3 and the instructions, many further combinations may be seen, so that even with an instruction from the die, many possible moves may be made and of course the choice of which one of your pieces to move is entirely up to the individual player.

While a preferred embodiment has been illustrated in detail, with some variations mentioned, for purposes of illustration and the advantages of the details, it is contemplated that further embodiments, modifications and variations are possible according to the broader aspects of the present invention, all as defined by the spirit and scope of the following claims.

What is claimed is:

1. Game apparatus, comprising:

a game board having a top surface divided by indicia into playing positions and non-playing positions being arranged in a grid formed by a plurality of rows extending between two opposite sides of the game board and columns extending between two opposite ends of the game board, with an orientation of the game board such that two players will respectively assume positions adjacent the opposite ends of the game board; said playing and non-playing positions being divided into three areas; the first area comprising playing spaces having first playing indicia alternating with non-playing spaces having second non-playing indicia different from said first indicia around the entire outer periphery of the game board as defined by the outermost columns and rows; a second playing area within the first area being defined by a plurality of playing spaces having playing indicia different from said second indicia connected in a continuous four-sided ring; a third non-playing area within the ring having non-playing indicia different from the first indicia; and directional indicia on said second area indicating distinct forward and backward directions of annular playing movement around said ring;

a chance controlled member having a plurality of faces; one of said faces being provided with directional indicia correlated to said first-mentioned directional indicia on said second playing area representing game piece move instructions of only said forward playing direction of movement around the ring;

another of said faces being provided with directional indicia different from the directional indicia of said one face and correlated to said first-mentioned directional indicia on said second playing area representing game piece move instructions of only said backward playing direction of movement around the ring; and a first set of game pieces substantially identical to each other and adapted to be placed only on the playing spaces, and a second set of substantially identical game pieces having indicia distinguishing them from the first set of game pieces, so that each player may have their own set of game pieces.

2. The apparatus of claim 1, wherein said chance controlled device is a cube shaped die having six faces respectively provided with indicia representing forward moves of one to three spaces and indicia representing beackward moves of one to three spaces.

3. The apparatus of claim 1, wherein the playing positions in said ring are in a first common plane, and the remainder of said playing and non-playing positions being in a second common plane spaced above the first plane, providing vertically extending surfaces between the three areas to separate the areas of different types of play.

4. The apparatus of claim 1, wherein said first area is defined by at least two columns along each side of said board and at least two rows along each end of said board.

5. The apparatus of claim 1, wherein said first area is defined by at least three columns along each side of said board and at least three rows along each end of said board.

6. The apparatus of claim 5, wherein there are a total of ten columns and ten rows, with the central ring being defined by the intersection of the fourth column in from each side with the central four rows and the intersection of the fourth row in from each end with the central four columns.

7. The apparatus of claim 6, wherein the intersection of the central two columns with the central two rows defines a non-playing area devoid of playing positions.

8. The apparatus of claim 7, wherein the four corner positions of the ring are provided with said directional indicia representing direction of movement distinguishing them from all the other playing and non-playing positions.

9. The apparatus of claim 8, wherein there are sixteen playing pieces in each set of game pieces for occupying the fifteen playing positions in the first three rows immediately in front of the respective players and occupying one additional playing position within the central ring.

10. The apparatus of claim 9 wherein the playing positions in said ring are in a first common plane, and the remainder of said playing and non-playing positions being in a second common plane spaced above the first plane;

wherein said move instructions include indicia indicating the number of spaces to be moved;

wherein said chance controlled device is a cube-shaped die having six faces respectively provided with the numerical indicia representing forward moves of one to three spaces.

11. The apparatus of claim 6, wherein there are sixteen playing pieces in each set of game pieces for occupying the fifteen playing positions in the first three rows immediately in front of the respective players and occupying one additional playing position within the central ring.

* * * * *